US005695363A

United States Patent [19]

Micheletti et al.

[11] Patent Number: 5,695,363

[45] Date of Patent: Dec. 9, 1997

[54] LOCKING COAXIAL CABLE CONNECTOR AND ADAPTOR

[75] Inventors: Don Micheletti; John Swinmurn, both of Los Altos, Calif.

[73] Assignee: Raychem Corporation, Menlo Park, Calif.

[21] Appl. No.: 363,493

[22] Filed: Dec. 23, 1994

[51] Int. Cl.[6] ..... H01R 17/04

[52] U.S. Cl. ..... 439/578

[58] Field of Search ..... 439/578, 585, 439/675

[56] References Cited

U.S. PATENT DOCUMENTS

| | | | |
|---|---|---|---|
| 3,847,463 | 11/1974 | Hayward et al. | 439/578 |
| 4,053,200 | 10/1977 | Pugner . | |
| 4,583,811 | 4/1986 | McMils . | |
| 4,834,675 | 5/1989 | Samchisen | 439/578 |
| 4,869,679 | 9/1989 | Szegda | 439/272 |
| 4,902,246 | 2/1990 | Samachisen | 439/578 |
| 4,955,826 | 9/1990 | Potter et al. | 439/578 |
| 5,127,853 | 7/1992 | McMills et al. | 439/578 |
| 5,195,906 | 3/1993 | Szegda | 439/394 |
| 5,277,598 | 1/1994 | McMills et al. | 439/133 |
| 5,295,864 | 3/1994 | Birch et al. | 439/578 |
| 5,297,972 | 3/1994 | McMills et al. | 439/133 |
| 5,362,250 | 11/1994 | McMils et al. | 439/387 |
| 5,366,018 | 11/1994 | Van Steenwyk et al. | 439/578 |

FOREIGN PATENT DOCUMENTS

WO 90/15454 12/1990 European Pat. Off. .

*Primary Examiner*—Gary F. Paumen

*Attorney, Agent, or Firm*—William D. Zahrt, II; Herbert G. Burkard

[57] ABSTRACT

A coaxial locking cable connector when used in conjunction with a port adaptor precludes the use of a standard connector and provides increased security for signals emanating from a cable tap port or drop. The connector optionally includes redundant environmental sealing. An additional embodiment is an adaptor to adapt a standard cable splice or tap port to accept the connector and preclude acceptance of standard coaxial connectors.

1 Claim, 2 Drawing Sheets

LOCKING COAXIAL CABLE CONNECTOR AND ADAPTOR

TECHNICAL FIELD OF THE INVENTION

This invention relates to a coaxial cable connector. In particular, the invention relates to a locking coaxial cable connector and a coaxial cable tap port or splice adaptor for the connector. Although adaptable for various sizes and types of coaxial cable, the adaptor and connector's use in the field of flexible coaxial cable, such as RG59 and/or RG6 braided and/or quad shielded cable, is of particular focus for the invention.

BACKGROUND OF THE INVENTION

Coaxial cable is widely used in the communication industry. In particular, coaxial cable is used to transmit television and other communication signals in the cable television industry and the like. When such cable needs to be routed in through an apartment building or a house or from a distribution point, a flexible shielded cable is generally used. This cable contains a center conductor along which the signals are transmitted surrounded by a dielectric and one or more shielding layers of foil or wire metal braid surrounded by an outer dielectric. In more robust distribution coaxial cables, the center conductor is surrounded by a dielectric, such as an insulating foam, and thereafter a rigid outer metal conductor such as aluminum and optionally an additional outer dielectric layer to protect against corrosion.

A major problem in the CATV industry is the theft of signals from a distribution tap or a splice connection where a splitter may be included in the system to pirate off the signal without paying for it. Various designs have been proposed to render the theft of signals more difficult but there is still a need for a robust connector which may be easily used by the CATV operator but will present difficulties for an unauthorized person trying to take the signal.

One of the problems in designing systems against signal pirating involves the variations in port length on different tap port distribution points or splice connectors. Variations of only tenths of an inch create problems in making a universal connector. Thus, it would be highly desirable to have a system which makes all connection points uniformly regardless of lack of standardization of these threaded portions of the tap port or splice connectors from the multitude of manufacturers. Additionally, it would be highly desirable to have a connector which is self aligning and provides good environmental sealing. Also, it would be additionally highly desirable to have a connection system which precludes the public from gaining access to the port using common tools and easily purchased connectors. It would also be desirable to have a device for converting the standard ⅜th inch threaded port to a unique port requiring a connector specific tool to give mechanical leverage for installation and removal while providing environmental sealing if required by the customer.

SUMMARY OF THE INVENTION

The invention provides for all the previously mentioned desirable features as well as many others which would be obvious to the ordinary skilled artisan from a reading of the application. More specifically, the invention consists of a connector which includes a mandrel and a locking shell which require a specific tool for installation or removal. A mechanical type tool for increased leverage is needed because the connector requires 150 to 200 lbs. of force to install thus making hand installation and removal very difficult if not impossible. Included within the connector system is a port adaptor that is specifically configured to screw on a port. The adaptor contains a combination sealant and thread locker. The act of screwing the adaptor onto the port activates the adhesive sealant which provides both thread locking and sealing. The sealant provides environmental protection between the port and the adaptor. The adaptor has a configuration which provides a locking feature when the connector is terminated. Thus even if the connector is removed, a standard threaded connector will no longer fit the port. The mandrel is configured to mate with the adaptor.

Optionally the mandrel can contain features to lock onto the adaptor. The mandrel in preferred embodiments has fingers which close around the adaptor. The fingers may optionally have a locking feature as determined by the customer. The cable connects and is locked onto the cable connecting portion of the mandrel. The locking shell has several functions. It carries the cable/shell locking and sealing element (these components lock the cable to the mandrel and proved an environmental seal between the cable and the shell). Secondly as the shell is pushed forward on installation, it closes the mandrel fingers around the adaptor to lock the mandrel to the adaptor (the mandrel and adaptor may be smooth or with a locking feature). Another feature as the shell moves forward on installation is that it engages the seal on the adaptor, providing an environmental seal to the adaptor, and then engages the adaptor (by an interference or a locking fit) to firmly lock, e.g. 150 to 200 lbs installation and removal force, the entire connector to the adaptor. Although installation is mechanically straightforward, the connector can only by installed or removed with a specially sized tool to give the necessary mechanical leverage so that unauthorized people cannot remove the connector from the tap port or splice.

DESCRIPTION OF THE PREFERRED EMBODIMENTS

Figure 1:
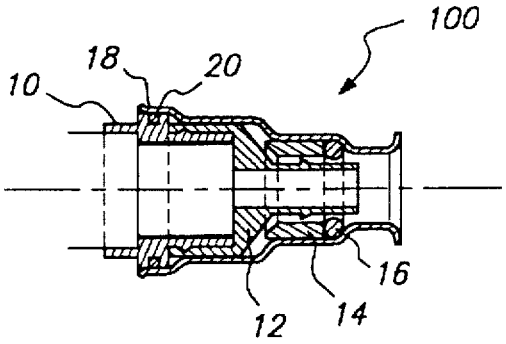
FIG. 1 illustrates a view in cross section of a preferred embodiment of the connector of the invention.
Figure 2:
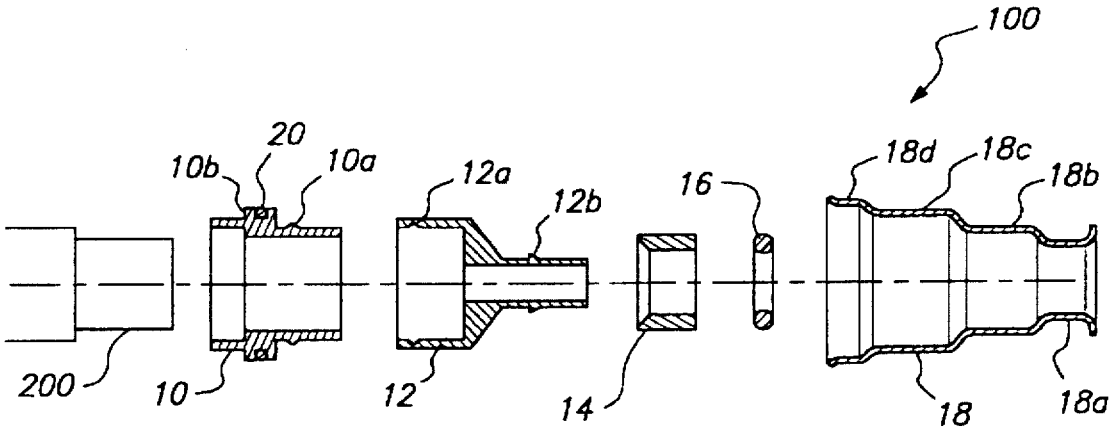
FIG. 2 is an exploded view of the embodiment of FIG. 1.

The preferred embodiments of the invention will be more particularly described and illustrated in reference to FIGS. 1 and 2. The connector 100 is illustrated in FIGS. 1 and 2. More specifically, the connector includes a port adaptor 10 to adapt the port 200 to a uniform size of the connector and also to remove the threads thereon facing the environment such that an unauthorized person cannot use a standard screw on connector. The adaptor 10 further includes a ridge 10*a* which will seat in a mandrel 12 upon installation and a ridge 10*b* from which the installation tool gains leverage with groove 18*a* in locking shell 18. The adaptor 10 also includes a sealing region 20 to effectively seal the outer locking shell to the adaptor. A suitable seal is an elastomeric member such as a circular or rectangular in cross section "O" ring seal.

A mandrel 12 is mounted on the connector, which can be prepared by any suitable method such as those illustrated in patents U.S. Pat. No. 4,834,675; U.S. Pat. No. 4,583,811; U.S. Pat. No. 5,127,853; and U.S. Pat. No. 5,277,598. The preferred preparation of the cable is as illustrated in U.S. Pat.

Nos. 4,583,811 and/or 5,127,853 and/or Raychem's EZF® connector brochures. The disclosures of each of these four patents are completely incorporated herein by reference for all purposes. In general, these patents, inter alia, illustrate suitable methods of preparing the cable for various types of coaxial cable connectors.

Figure 3A:
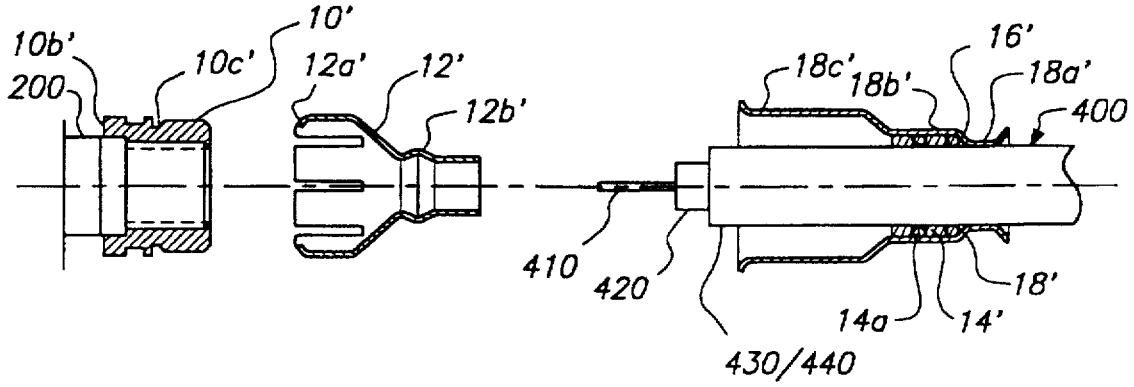
FIGS. 3*a* through 3*c* illustrate the installation of an alternative embodiment of the invention but the process is the same as for the FIGS. 1 and 2 embodiment.

The mandrel 12 includes a circumferential groove (a detent in cross-section) 12*a* inside the fingers thereat (c.f. FIG. 3*a* and U.S. Pat. No. 5,127,853) which are intended to attach and lock to the extent 10*a* (circumferential ridge) on the adaptor. Of course, the adaptor 10 could have the detent and the mandrel 12 could have the extent. The fingers have resilience and thus any suitable metal having such resilience is preferred for the mandrel. A suitable finger configuration is taught in U.S. Pat. No. 5,127,853 the disclosure of which is completely incorporated herein by reference for all purposes. Additionally, the mandrel 12 includes a knife edge illustrated as 12*b* to form a good electrical contact to the outer metallic shielding layer. Optionally, a helical knife edge as taught in U.S. Pat. No. 5,127,853 could be employed.

Additionally, the connector includes a cable lock 14 which applies over the mandrel and is compressed down to trap the outer electrical shielding and dielectric between the mandrel and the cable lock 14. The cable lock is preferably a low stress relaxing low creep plastic but soft metals such as brass could also be used. Shell 18 at 18*b* further restrains and locks the connector upon installation. Adjacent to an end of the cable lock away from the tap port 200 is a suitable cable seal such an "O" ring 16 such as illustrated.

Figure 3B:
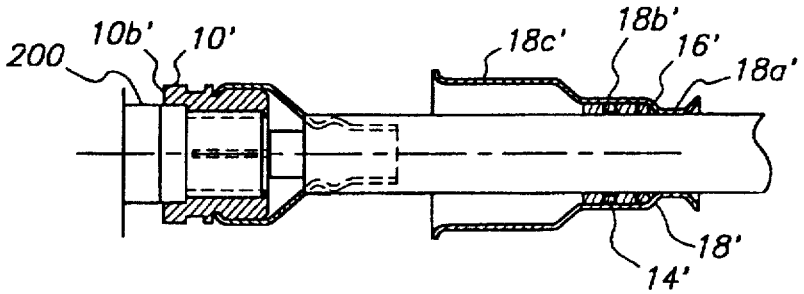
Figure 3C:
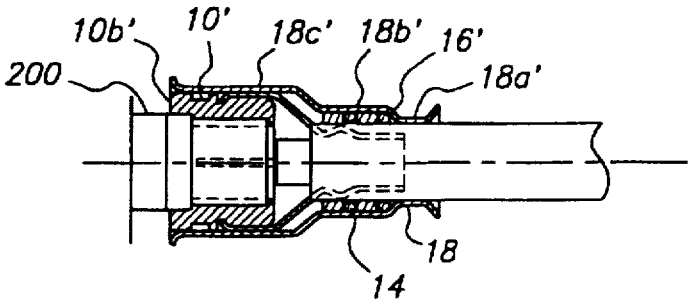

With a prepared cable, the locking shell is slid along the cable over the outer dielectric of the cable. Thereafter, the locking shell is slid along the cable towards the mandrel at the end of the cable to compress the cable (c.f. FIGS. 3*b* and 3*c*) seal 16 and adaptor seal 20 and lock the mandrel 12 and cable lock 14 to the adaptor 10. The extent 10*a* and the shell 18 at diameter 18*c* form a tight interference fit. A further seal occurs by the compression of seal 20 by the shell at 18*c*.

A key feature of the overall connector system is the adaptor 10 which is sized to fit over the port 200 and with the exception of the extent 10*a* and ridge 10*b*, has a smooth outer surface relative to where a standard connector would attach. This adaptor standardizes the interface between the connector and tap port compensating for varying tap port lengths as well as precluding the application of a standard connector. The interior of the adaptor 10 includes an adhesive or an anaerobic sealant such as Locktight® or any suitable means which upon threading the adaptor onto the tap port or splice firmly bonds the adaptor thereto to prevent removal therefrom and convert the tap port or splice to uniform dimensions for use with the connector. Thus, the adaptor in and of itself is a particularly preferred embodiment because other connectors can be created which mate with the adaptor but are not generally available to the public. This provides security for the cable operator.

Additionally features can be included with the invention such as means to seal the port when not in use as described in U.S. application Ser. No. 08/118,119 filed Sep. 7, 1993, now issued U.S. Pat. No. 5,435,736, dated July 1995, the complete application of which is completely incorporated herein by reference for all purposes.

In operation, the cable is prepared in a standard manner with a removal of the outer and inner dielectrics and outer shielding layers to expose a length of the central conductor. Thereafter a portion of the outer dielectric is removed to expose the braiding which is folded back or optionally, if a helical screw mandrel is used, the cable is terminated substantially perpendicular to the center conductor with the dielectrics and outer shielding layers and the mandrel is urged or threaded onto the cable. Thereafter the cable lock is connected, binding the mandrel securely to the cable, and the system is applied to the adaptor with the locking shell moving along the longitudinal axis of the cable and snapping onto and over the adaptor and the cable lock compressing the seals to affect an environmental seal. This is done by a suitable tool which connects to the adaptor 10 at ridge 10*b* and at 18*a* of the shell and urges the shell together with the adaptor with the installation force in excess of about 100 lbs and preferable 150 to 200 lbs of force through the mechanical leverage. This makes the installation and removal very difficult if not impossible by unauthorized persons. Even if removed the adapter cannot be removed without destroying the port and thus standard threaded connectors cannot be used once the conversion occurs.

FIGS. 3*a*, 3*b*, 3*c* illustrate the installation of an alternative embodiment of the connector. However, the process for either connector is the same. Analogous elements are marked with a prime. The adaptor 10' is sealingly threaded onto the port 200. The installation tool squeezes the connector/adaptor together at 10*b*' and 18*a*'. In this embodiment the extent 12*a* is replaced by clasping turns 12*a*' on the ends of the fingers. A suitable number of fingers is from 2 to 10 but generally 3 or 4 fingers are preferred. The prepared cable 400 with center conductor 410 and exposed dielectric 420 with outer shielding 430 and dielectric 440 is inserted into the shell 18' and through cable lock 14'. The cable lock includes an extra seal 14*a*' in addition to seal 16' for even better sealing. Upon installation, the shell at 18*c*' grips the mandrel 12' to the port adaptor 10' while the fingers at 12*a*' seat in groove 10*c*'. Region 18*b*' traps the cable lock 14' to the mandrel 12' with the elements 430/440 therebetween. In this embodiment, the knife edge is replaced with a ridge 12*b*' but the function is the same i.e. to create the electrical contact to shield 430. The installation and removal force of greater than 100 lbs. helps ensure only authorized personnel will use the connector.

The invention has been described with particularly preferred embodiments. Modifications which would be obvious to one of ordinary skill in the art are contemplated to be within the scope of the invention, for example, the seals could be eliminated if the environment warranted. Additionally, the means of forming a good electrical contact to the outer shielding could be any effective means. Additionally, a plurality of extents on the adaptor might be used to secure the mandrel, and the like. Modifications which would be obvious to one of ordinary skill in the art as well as the full and complete equivalence upon a reading of the specification are contemplated to be within the scope of the invention and the appended claims.

What is claimed is:

1. An adaptor to adapt a cable splice or tap port to uniform dimensions, comprising:

a tubular adaptor member having means for mating to such a port or splice, an external portion of the adaptor member including a region making it capable of lockingly mating to a connector, a mandrel capable of mating to a coaxial cable, the mandrel including two tubular portions, the first tubular portion sized to accommodate the adaptor member and the second tubular portion sized to accommodate a coaxial cable such that it fits between the inner dielectric and the outer shielding layer of such a cable, the mandrel further including an electrical contacting portion on the exterior of the second tubular portion of the mandrel for contacting the outer shielding and a region in the mandrel capable of lockingly mating with the adaptor member, a cable lock tubular member which fits over the exterior of the coaxial cable and creates a forced fit between the mandrel and the outer shielding layer as well as any present outer dielectric, the cable lock being a tubular member having a chamfered opening to assist in mounting over the cable and the mandrel and a portion opposite thereto capable of accepting a seal, an outer locking shell which can compress such a seal adjacent the cable lock, and which locks to the mandrel as the mandrel locks to the adaptor member, the locking shell having three varying diameters to assist with the mating to the adaptor member, the mandrel, and such a seal such that its appearance in cross section is the abutment of step down tubular members, and an additional step down and flared portion opposite to the portion contacting the adaptor member on the locking shell to provide strain relief and sealing to the cable.

* * * * *